US005956759A

United States Patent [19]

Benedict

[11] Patent Number: 5,956,759

[45] Date of Patent: Sep. 28, 1999

[54] HEAD GEAR HAVING EVAPORATIVE COOLING BAND

[76] Inventor: Cindy Benedict, 28052 Camino Capistrano, Suite 207, Laguna Niguel, Calif. 92677

[21] Appl. No.: 09/150,497

[22] Filed: Sep. 9, 1998

Related U.S. Application Data

[60] Provisional application No. 60/058,368, Sep. 9, 1997.

[51] Int. Cl.[6] ..... A42C 5/00

[52] U.S. Cl. ..... 2/7; 2/171.2; 2/181; 2/DIG. 11; 607/110

[58] Field of Search ..... 2/7, 171.2, 181, 2/181.2, 181.4, 411, 412, 413, 414, DIG. 11; 607/110

[56] References Cited

U.S. PATENT DOCUMENTS

| | | | |
|---|---|---|---|
| 4,101,981 | 7/1978 | Boden . | |
| 4,204,543 | 5/1980 | Henderson . | |
| 4,550,446 | 11/1985 | Herman . | |
| 4,815,144 | 3/1989 | Martin . | |
| 5,327,585 | 7/1994 | Karlan . | |
| 5,365,607 | 11/1994 | Benevento, Jr. et al. . | |
| 5,572,745 | 11/1996 | Mainus | 2/7 |
| 5,630,230 | 5/1997 | Fujino et al. . | |
| 5,715,533 | 2/1998 | Stein | 2/7 |

*Primary Examiner*—Diana L. Oleksa
*Attorney, Agent, or Firm*—Levin & Hawes; James E. Hawes; Dennis S. Morris

[57] ABSTRACT

The present invention provides for a means to cool the head of a wearer by incorporating in a flexible tube, a liquid adsorbent material which provides for evaporative cooling of the liquid and thus cooling of the head of the wearer. The adsorbent material can be easily re-saturated with liquid by simply immersing the whole invention under the liquid or under a flow of the liquid. The device is easy to manufacture and simple to maintain.

10 Claims, 2 Drawing Sheets

HEAD GEAR HAVING EVAPORATIVE COOLING BAND

CROSS-REFERENCE

This applications claims the benefit and priority of a Provisional U.S. application Ser. No. filed Sep. 9, 1997 and assigned Ser. No. 60/058,368.

BACKGROUND OF THE INVENTION

The present invention relates to a cooling means provided within a hat, cap or similar item of apparel. In particular, the present invention relates to a means for retaining within a flexible tubular sheath, a material capable of absorbing a liquid and subsequently providing a matrix for the evaporation of that liquid and the subsequent cooling of surfaces in contact with the flexible tubular sheath.

By way of background, attention is called to the following United States Letters Patents which have each been examined during the course of the present invention and found to be technically distinguishable from the instant teachings, as claimed below in this application as new, novel and nonobvious within the definition prescribed by statute: U.S. Pat. Nos. 5,365,607; 5,630,230

No disclosures among the prior art have addressed the problems solved by the instant teachings, which demonstrate the contributions of the present inventor to the progress of science and the useful arts.

OBJECTS AND SUMMARY OF THE INVENTION

Accordingly, it is an object of this invention to provide an apparatus effective for cooling the head of a wearer which eliminates the drawbacks of the prior art.

It is another object of the present invention to provide a means for cooling which has no removable components which can be lost or misplaced.

It is still another object of the present invention to provide a means for cooling the head which does not require the pre-cooling, refrigeration or freezing of any component of the invention.

According to another object of the present invention, there is provided a cooling means that can be quickly recharged anywhere there is a source of a suitable evaporative liquid.

According to another object of the present invention, there is provided a cooling means which can be completely submersed in a suitable liquid in order to provide a convenient means of recharging the adsorbent material with an evaporative liquid.

According to yet another object of the present invention, the invention should be fully washable and compatible with all common detergents for the purpose of maintaining acceptable appearance and hygiene of the invention.

Briefly stated, there is provided a hat, cap or similar item of head apparel containing therein a tube of flexible material containing adsorbent material which retains a suitable liquid and provides a matrix for the evaporation of the liquid. The tube and its contents are cooled by the evaporation of the adsorbed liquid. With the tube in contact with the head of the wearer, it thus imparts a cooling effect to the head of the wearer.

The above, and other objects, features and objectives of the present invention, shall become apparent with the following description whether in conjunction with the accompany drawings, in which like reference numerical designating indicators designate the same elements.

There are many applications for instant invention. A common use would be for use by athletes during sporting events and other periods of exertion. In addition, workers in all types of environments would benefit from the cooling effects of the instant invention. The instant invention is also useful in medical and health care situations where reducing or maintaining body temperature is desired. A particular application is the use of the present invention during certain kinds of chemotherapy. Hair loss can be minimized if the hair follicles can be maintained at a lower temperature during the administration of the chemotherapy agents.

BRIEF EXPLANATION OF THE DRAWINGS

The invention may best be understood by reference to the following descriptions taken in conjunction with the accompanying drawings in the several figures of which like reference numerals identify like elements and in which.

DETAILED DESCRIPTION OF PREFERRED EMBODIMENT

The present invention comprises a flexible tube containing an adsorbent material, the tube being attached to the cavity of a cap, hat or similar item of head apparel such that the tube is held in close contact with the head of a wearer. If a liquid, which has previously been adsorbed by the adsorbent material, is allowed to evaporate, the cooling effect of the evaporation will cool the tube, the adsorbent contents and the head of the wearer.

Though the preferred liquid is plain water, nothing in the scope or sprite of the invention precludes the use of other liquids provided that they can be absorbed by the absorbent material, will evaporate and are non-toxic.

Figure 1:
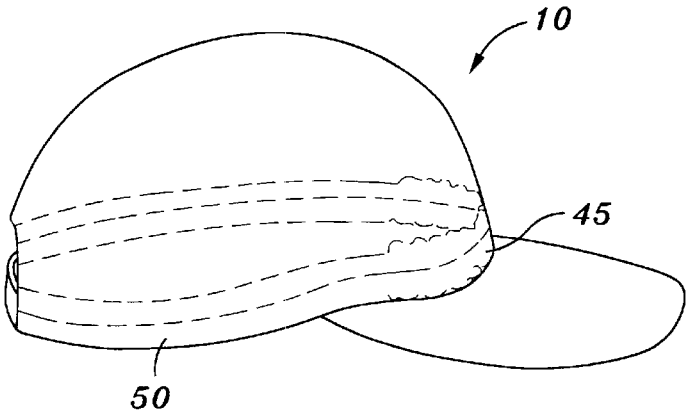
FIG. 1 illustrates the flexible tubular sheath and its placement within the invention.

Turning now to FIG. 1, Flexible Tube 50 is shown attached to the periphery of the underside of the Evaporative Cooling Hat 10. Adsorbent Material 45 is shown contained within Flexible Tube 50. As shown in FIG. 1, the Flexible Tube 50 is composed of two parallel chambers connected to each other in order to better control the placement of the Adsorbent Material 45. However, Flexible Tube 50 could be composed of a smaller or larger number of chambers based upon particular needs. Also as shown, Flexible Tube 50 is shown as a continuous pair of chambers running almost the entire periphery of the underside of Evaporative Cooling Hat 10. This construction simplifies manufacture by reducing the time it takes to produce and the number of steps needed to produce the present invention. However, it is within the scope and spirit of the invention to divide Flexible Tube 50 into smaller segments if a particular need would so dictate.

Figure 2:
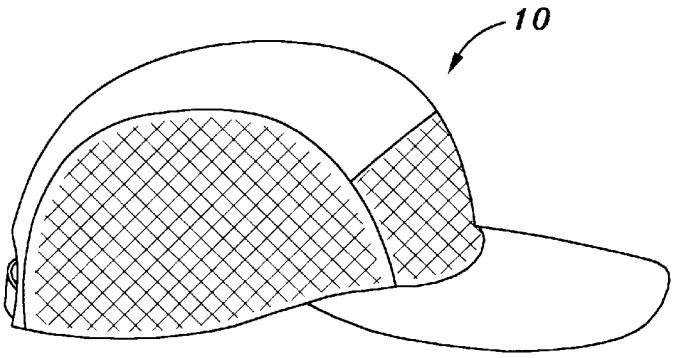
FIG. 2 illustrates a general perspective view of one embodiment of the invention.

Turning now to FIG. 2, Evaporative Cooling Hat 10 is shown in perspective view to provide a general understanding the instant invention.

Figure 3:
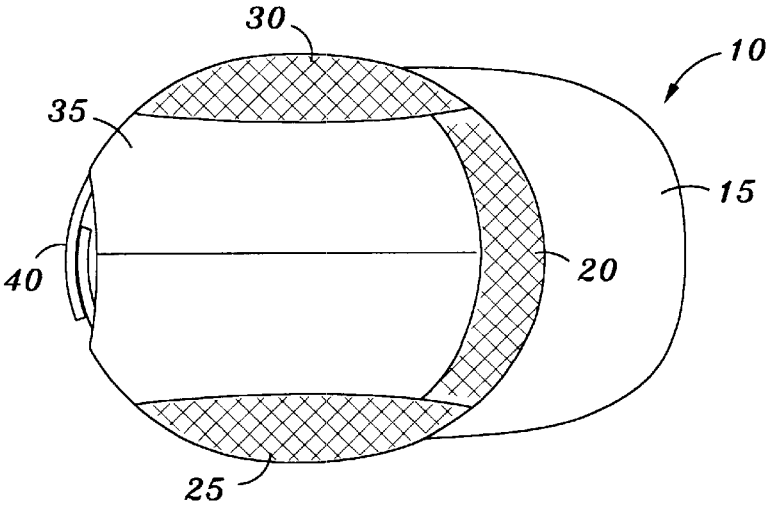
FIG. 3 illustrates a top view one embodiment of the invention.

Turning now to FIG. 3, Evaporative Cooling Hat 10 is shown in a top view, with the following components shown. Brim 15 is shown attached to the front periphery of the Evaporative Cooling Hat 10. The upper portion of Evaporative Cooling Hat 10 is composed of several panels: Front Panel 20, Right Panel 25, Left Panel 30 and Top Panel 35. As shown, Front Panel 20, Right Panel 25, and Left Panel 30 are composed of a mesh material. The mesh facilitates air flow over the Flexible Tube 50 in order to promote evaporative cooling. Mesh is considered to be a fabric characterized by open spaces between the yarns. Mesh fabric may be woven, knit, lace, net or crochet. Top Panel 35 is shown as a solid piece of material which protects the wearer from the heat of the sun if Evaporative Cooling Hat 10 is worn outdoors. The percentage of the present invention which is solid material as opposed to mesh material can be changed or altered to fit the needs of a particular environment. Evaporative Cooling Hat 10 could be made entirely of solid material if the need to protect the wearer from the sun was high. However, the cooling efficiency would be decreased due to the reduced airflow over Flexible Tube 50. In that case, a breathable material could be used which would allow some air flow over the Flexible Tube 50. Likewise, where heat from the sun is not a concern, the Evaporative Cooling Hat 10 could be made almost entirely of mesh material to promote airflow over Flexible Tube 50.

Figure 4:
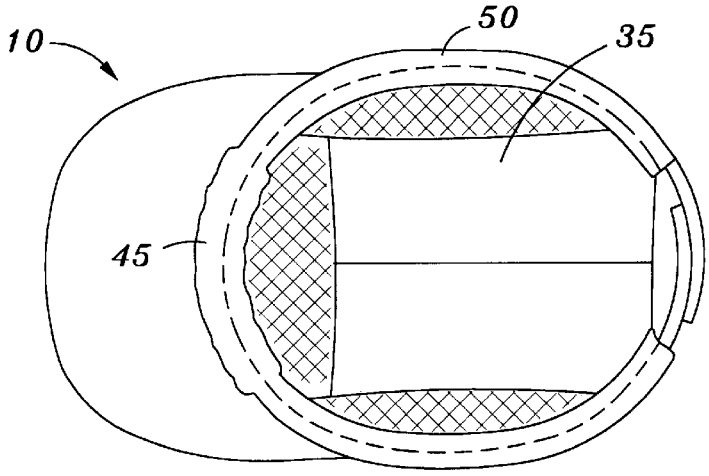
FIG. 4 illustrates an underside view of the invention when the adsorbent material contains no liquid.

At the rear periphery of Evaporative Cooling Hat 10 is Adjustable Closure 40. In order for Evaporative Cooling Hat 10 to be maximally effective, the Flexible Tube 50 needs to be in snug contact with the head of the wearer. Adjustable Closure 40 permits the size of the Evaporative Cooling Hat 10 to be altered by the wearer to snugly fit the wearer'shead. Though shown in FIG. 3 as a pair of snapping, adjustable and overlapping straps, a number of alternative means are equally usable including a simple elastic strap and by overlapping hook and loop fasteners. Turning now to FIG. 4, Evaporative Cooling Hat 10 is shown from the underside with the Absorbent Material 45 having no absorbed liquid. When dry, Adsorbent Material 45 tends to shrink in size and loosely aggregate as shown by the slight bulging of Flexible Tube 50 at the front of Evaporative Cooling Hat 10. However, the dry Adsorbent Material 45 can be distributed anywhere within Flexible Tube 50. Flexible Tube 50 is shown attached to the periphery of the underside of Evaporative Cooling Hat 10 and running along most of the underside of the periphery of Evaporative Cooling Hat 10. Depending upon the exact nature of Adjustable Closure 40, Flexible Tube 50 maybe located along the entire periphery of the underside of Evaporative Cooling Hat 10. Top Panel 35 is shown for reference purposes.

Figure 5:
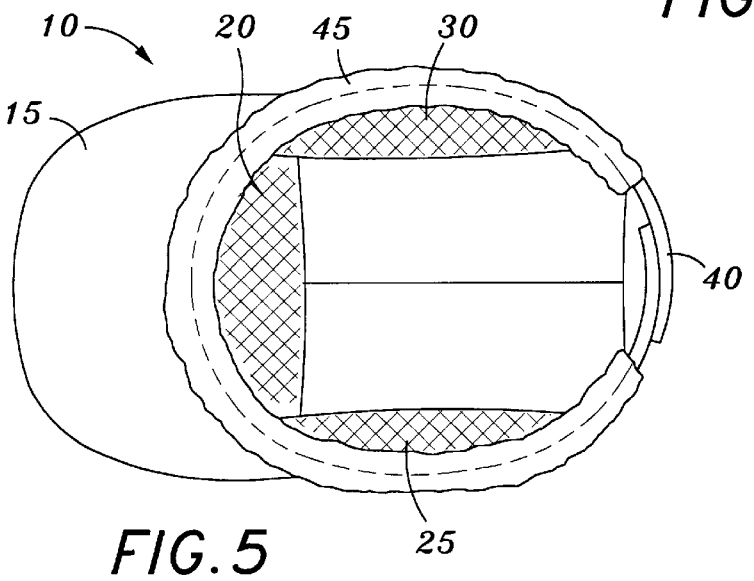
FIG. 5 illustrates an underside view of the invention when the adsorbent gel is saturated with liquid.

Turning now to FIG. 5, Evaporative Cooling Hat 10 is shown from the underside with the Absorbent Material 45 being saturated with a liquid and thus swelling and expanding to fill Flexible Tube 50. Other reference numbers indicate previously discussed components of the instant invention and are included for reference purposes.

Absorbent Material 45 can be any material which can adsorb large quantities of liquid, preferably water, and hold that liquid for the purpose of facilitating evaporative cooling. The preferred choice for Absorbent Material 45 is a cross-linked modified acrylic polymer which adsorbs large quantities of water, is safe for use around persons and animals, is relatively inexpensive and can undergo many cycles of adsorption and evaporation without degradation. Absorbent Material 45 is readily available from various commercial suppliers and is identified with the Chemical Abstracts Number 71042-87-0.

ALTERNATIVE EMBODIMENT

Figure 6:
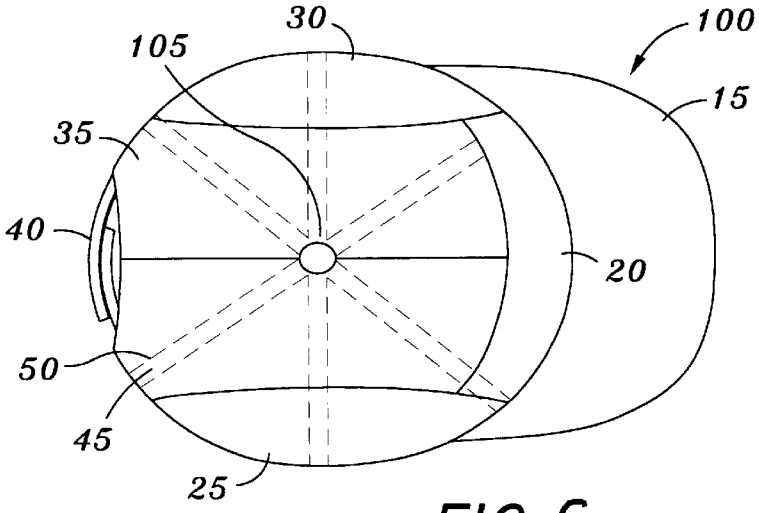
FIG. 6 illustrates an alternative embodiment in which the flexible tubes containing the adsorbent are positioned across the top of the hat.

An alternative embodiment is now described by making reference to FIG. 6. High Coverage Evaporative Cooling Hat 100 is shown in a top view. Flexible tubes 50 are shown running from the lower periphery of the High Coverage Evaporative Cooling Hat 100 to meet at the Crown 105. Though six Flexible Tubes 50 are shown, there could be any number of Flexible Tubes 50 used. In fact, the whole upper portion of the High Coverage Evaporative Cooling Hat 100 could be a series of Flexible Tubes 50 completely closing in the upper portion of the High Density Evaporative Cooling Hat 100. As shown in FIG. 6, Flexible Tubes 50 are shown as beginning at the lower periphery of the High Density Evaporative Cooling Hat 100 and ending at the Crown 105. However, one or more of Flexible Tubes 50 could run from the periphery of the hat on one side, across the Crown 105 and terminate at the periphery of the hat on the other side.

This design enables a much higher level cooling to be made available by increasing the number of Flexible Tubes 50 that make up the upper portion of the High Density Evaporative Cooling Hat 100.

This High Density Evaporative Cooling Hat 100 is shown in this view as having solid material for the panels. This was done in order to better view the representation of the Flexible Tubes 50. As discussed previously, the High Density Evaporative Cooling Hat 100 could be constructed with all solid material panels or all mesh panels in order to meet the design needs of the end user.

As shown in the previously described embodiments, Flexible Tubes 50 can be positioned in a number of arrangements and still provide a cooling effect for the wearer. Indeed, a combination of the two embodiments would provide cooling around temples and forehead with the Flexible Tubes 50 that are position along the lower periphery of the hat and additional cooling would be provided by having a series of Flexible Tubes 50 running over the top of the hat.

Having described the preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An article of head apparel for cooling the head of a wearer comprising:

a head covering portion having a plurality of panels forming a cavity for receiving the head of a wearer, said cavity having a lower peripheral edge;

a plurality of flexible tubes attached to said cavity;

adsorbent material fixedly retained within said flexible tubes, said adsorbent material being adapted to adsorb a liquid and subsequently allow said liquid to evaporate whereby said evaporation cools the head of a wearer.

2. An article of head apparel as described in claim 1 wherein said plurality of panels is comprised of at least one panel that permits air flow over at least one of said plurality of flexible tubes.

3. An article of head apparel as described in claim 2 wherein at least one of said plurality of panels that permit air flow over at least one of said plurality of flexible tubes is composed of breathable fabric.

4. An article of head apparel as described in claim 3 wherein said at least one of said plurality of flexible tubes is composed of a plurality of chambers attached to said cavity.

5. An article of head apparel as described in claim 4 wherein said at least one of said plurality of flexible tubes is positioned along said lower peripheral edge of said cavity.

6. An article of head apparel as described in claim 4 wherein said plurality of chambers are positioned along the inside surface of said cavity.

7. An article of head apparel as described in claim 2 wherein at least one of said plurality of panels that permit air flow over at least one of said plurality of flexible tubes is composed of a flexible mesh.

8. An article of head apparel as described in claim 7 wherein said at least one of said plurality of flexible tubes is composed of a plurality of chambers attached to said cavity.

9. An article of head apparel as described in claim 8 wherein said at least one of said plurality of flexible tubes is positioned along said lower peripheral edge of said cavity.

10. An article of head apparel as described in claim 8 wherein said plurality of chambers are positioned along the inside surface of said cavity.

* * * * *